United States Patent [19]

Milleron

[11] 4,422,822

[45] Dec. 27, 1983

[54] ROTATING FIBER ARRAY MOLECULAR DRIVER AND MOLECULAR MOMENTUM TRANSFER DEVICE CONSTRUCTED THEREWITH

[76] Inventor: Norman Milleron, 1854 San Juan, Berkeley, Calif. 94707

[21] Appl. No.: 176,971

[22] Filed: Aug. 11, 1980

[51] Int. Cl.[3] ..... F01D 1/34

[52] U.S. Cl. ..... 415/90; 415/206

[58] Field of Search ..... 415/90, 206, DIG. 4

[56] References Cited

U.S. PATENT DOCUMENTS

| | | | |
|---|---|---|---|
| 2,997,847 | 8/1961 | Hollingsworth | 60/39.38 |
| 2,998,099 | 8/1961 | Hollingsworth | 415/90 |
| 3,737,694 | 6/1973 | Rabenhorst | 310/74 |
| 3,826,588 | 7/1974 | Frank | 415/90 |
| 4,111,595 | 9/1978 | Becker et al. | 415/90 |

FOREIGN PATENT DOCUMENTS 715820 2/1980 U.S.S.R. .

*Primary Examiner*—Louis J. Casaregola
*Attorney, Agent, or Firm*—Parkhurst & Oliff

[57] ABSTRACT

A rotating fiber array molecular driver is disclosed which includes a magnetically suspended and rotated central hub to which is attached a plurality of elongated fibers extending radially therefrom. The hub is rotated so as to straighten and axially extend the fibers and to provide the fibers with a tip speed which exceeds the average molecular velocity of fluid molecules entering between the fibers. Molecules colliding with the sides of the rotating fibers are accelerated to the tip speed of the fiber and given a momentum having a directional orientation within a relatively narrow distribution angle at a point radially outward of the hub, which is centered and peaks at the normal to the fiber sides in the direction of fiber rotation. The rotating fiber array may be used with other like fiber arrays or with other stationary structures to form molecular momentum transfer devices such as vacuum pumps, molecular separators, molecular coaters, or molecular reactors.

20 Claims, 16 Drawing Figures

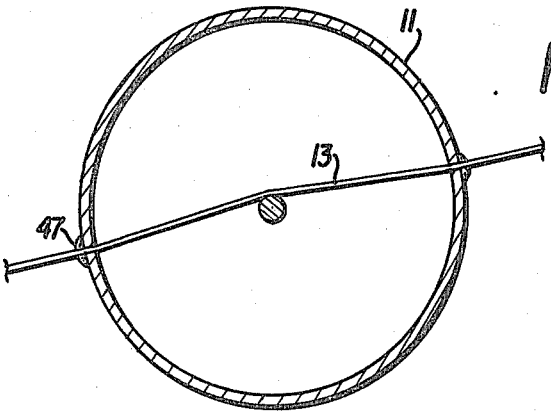
FIG. 4
FIG. 5
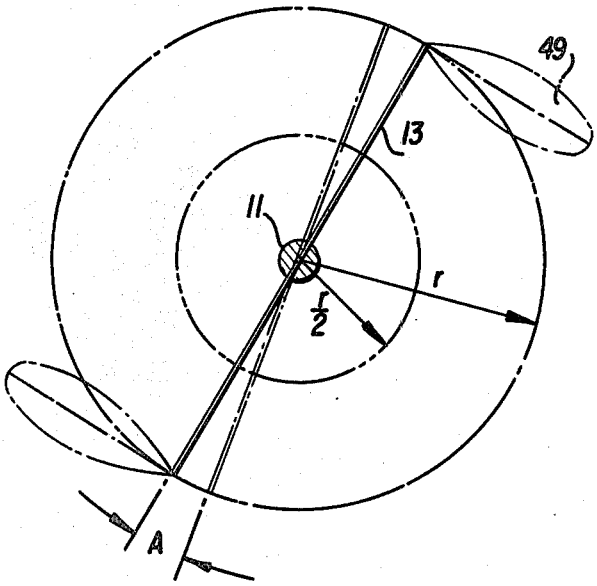
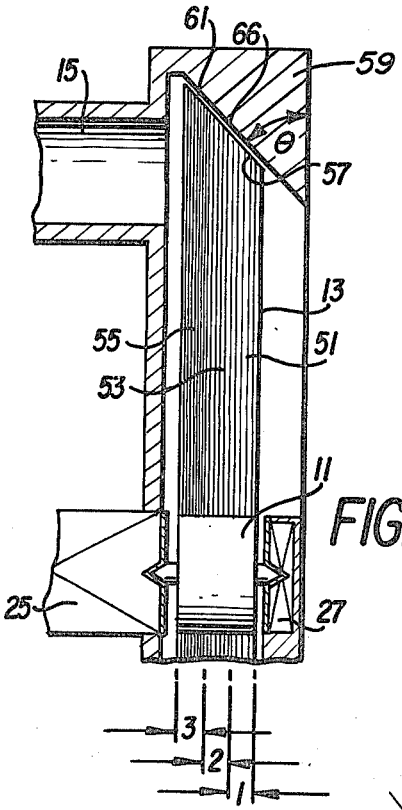
FIG. 6
FIG. 8B
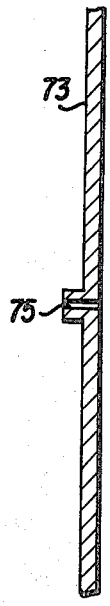
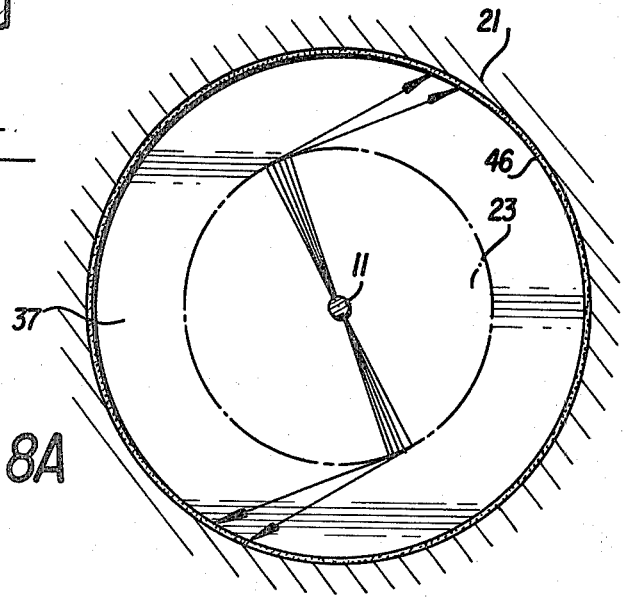
FIG. 8A FIG. 7A
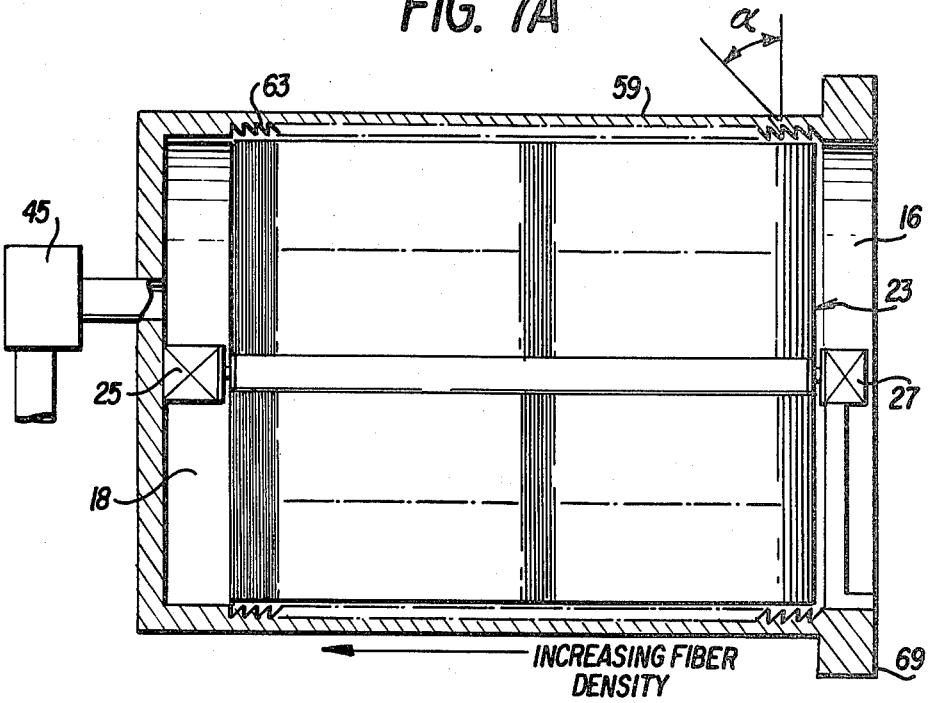
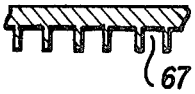
FIG. 7B
FIG. 9A
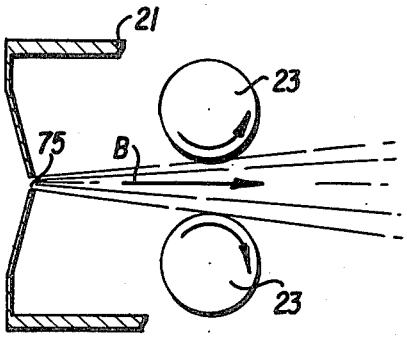
FIG. 9B
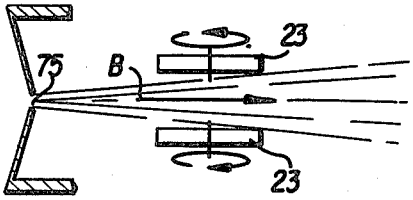
FIG. 9C
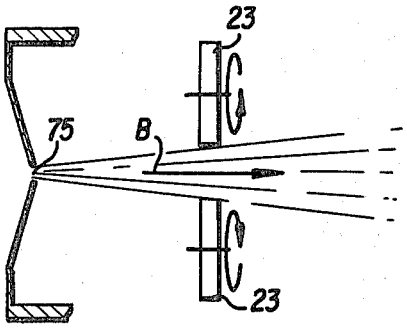
FIG. 10
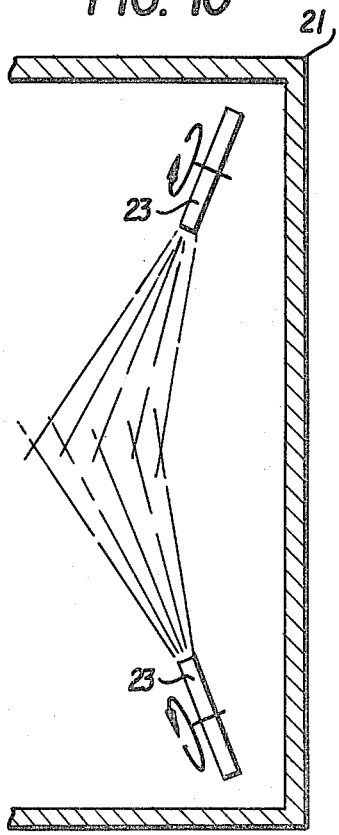

ROTATING FIBER ARRAY MOLECULAR DRIVER AND MOLECULAR MOMENTUM TRANSFER DEVICE CONSTRUCTED THEREWITH

BACKGROUND OF THE INVENTION

The present invention relates to a high speed molecular driver for transferring preferred momenta to gaseous molecules and to molecular momentum transfer devices constructed therewith. One exemplary use of the invention may be as a molecular vacuum pump for evacuating a chamber.

Presently known molecular momentum transfer devices include turbo molecular axial and radical flow pumps, molecular drag pumps and ejector and diffusion working fluid pumps.

All of the foregoing devices operate to move molecules by striking the same with one or more rotating elements or with a linear velocity set of solid or fluid elements; however, they all suffer from various drawbacks and deficiencies. One such deficiency of rotating devices is the high construction cost of the parts of such devices making them expensive, both to produce and maintain. Conventional molecular momentum transfer devices are also relatively heavy and bulky and consume a large amount of physical area and space. This also severely limits their mounting flexibility, for example, to a chamber containing a gas to be evacuated. The rotor structures of conventional molecular momentum transfer devices and the housing around them are also quite heavy. The strength to density ratio of the heavy rotor structure is a limiting factor on the achievable tip velocity of the rotating elements and considerable energy is stored therein during operation which may cause extensive damage if released, for example, by component breakage. In addition, the relatively heavy and bulky rotor structures require considerable driving and suspension structures which further limits obtainable tip velocity. An additional drawback to conventional momentum transfer devices is the considerable energy required to start, maintain and/or stop the rotating structures or to drive the working fluid of diffusion or ejector devices. A relatively low molecular transfer efficiency is also commonplace, especially for low molecular weight molecules because the driving velocity of the moving elements is too low.

One object of the present invvention is to overcome the above problems by providing a unique fiber array molecular driver and a molecular momentum transfer device constructed therewith having a rotor structure which is cheaper to manufacture and maintain, has a lower mass, requires less space, obtains a higher rotor tip velocity and which requires less energy in operation and construction and stores less energy when operating.

An additional object of the invention is to provide a fiber array molecular driver and a molecular momentum transfer device constructed therewith having a unique rotor structure which more assuredly directs molecules struck by the moving rotor to a predetermined direction, thus facilitating collection or removal of struck molecules and increasing the molecular transfer efficiency.

An additional object of the invention is to provide a fiber array molecular driver and a molecular momentum transfer device constructed therewith having a unique rotor structure which can be used in a variety of applications including a molecular pump, a thin film molecular coating device, a molecular separator, or a molecular reactor.

An additional object of the invention is to provide a fiber array molecular driver and a molecular momentum transfer device constructed therewith which requires lower energy for suspension and rotation of the rotor, makes the spacing between the rotor and suspension and rotation structures less critical and which can easily obtain a rotor tip speed which is higher than the average molecular speed of molecules colliding with the rotor.

These and other objects and advantages of the invention are achieved with a fiber array molecular driver and a molecular momentum device constructed therewith having a rotor structure comprising a central hub and an array of fine fibers attached to the hub which, during rotation at operating speed, stand radially outward of the hub at an angle normal thereto. The rotor is magnetically suspended and driven and may be used alone or with other like rotors and/or stationary structures to provide a molecular pump, a molecular gas separator, a coating apparatus for a substrate, or a reaction device wherein gas molecules are directed towards one another for collision.

At operating speed, the tip speed of the fiber array is greater than the average thermal velocity of the molecules which collide therewith such that preferred directional momenta are imparted to the struck molecules. The struck molecules leave the fibers with a distribution in a direction confined to a relatively narrow angle radially outward from the hub which is centered about and peaks around lines normal to the surface of the sides of the fiber tips in the direction of fiber rotation at each point of collision. This facilitates collection of the struck molecules and improves overall operating efficiency of the molecular momentum transfer device.

Additional objects and advantages of the unique fiber array molecular driver and molecular momentum transfer devices constructed therewith of the structure of the invention can be seen from the following detailed description thereof which is taken in conjunction with the accompanying drawings.

BRIEF DESCRIPTION OF THE DRAWINGS

FIG. 4 illustrates a top sectional view of the rotor hub showing the manner of attaching the fibers to the hub;

FIG. 5 illustrates a schematic representation of the fiber array rotor illustrated in FIGS. 1*a* and 2;

FIG. 6 illustrates a side sectional view of an alternative embodiment of a molecular pump employing a fiber array rotor having several fiber stages, with the fiber packing density increasing in successive fiber stages;

FIG. *7a* illustrates a side sectional view of another embodiment of a molecular pump utilizing a rotor having an increasing fiber packing density from one axial end of the hub to the other;

FIG. *7b* illustrates a modification to the sidewall structure of the pump illustrated in FIG. *7a;*

FIG. 8*a* illustrates a front view of a coating device using the fiber array rotor of the invention;

FIG. 8*b* illustrates a side view of a front wall of the device illustrated in FIG. 8*a;*

FIG. 9*a* illustrates in schematic form a gas separating device using a pair of fiber array rotors constructed in accordance with the invention;

FIG. 9*b* illustrates in schematic form a gas separating device similar to that of FIG. 9*a*, but with a different axial orientation of the rotors;

FIG. 9*c* illustrates in schematic form another variation of the device illustrated in FIG. 9*a* with another axial orientation of the rotors; and, FIG. 10 illustrates in schematic form a molecular reactor using a pair of fiber array rotors constructed in accordance with the teachings of the invention.

DETAILED DESCRIPTION OF THE INVENTION

Figure 1A:
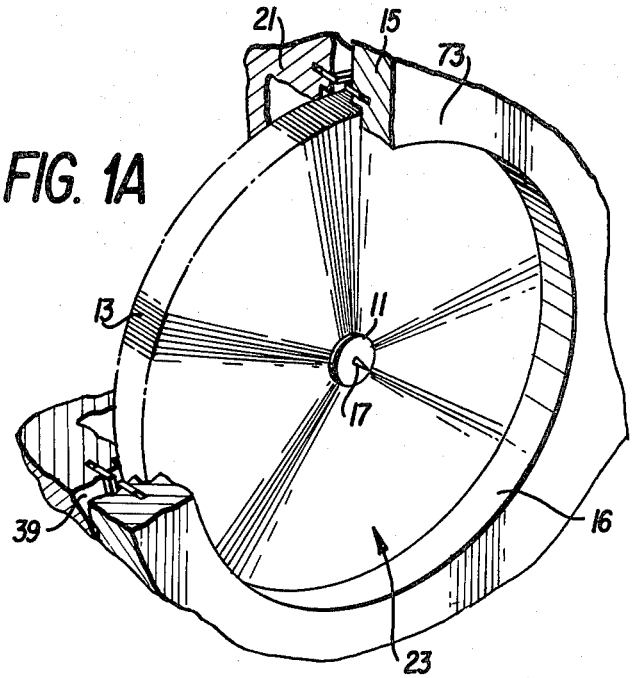
FIG. 1*a* illustrates in perspective view of a molecular pump using a fiber array rotor of the invention.

To facilitate subsequent discussion, the molecular momentum transfer device of the invention will be described at first with reference to its utility as a molecular pump. Such a pump is illustrated in FIG. 1*a* and includes a rotor 23 formed of a hub 11 and a plurality of fibers 13 extending radially therefrom at an angle normal to the hub surface. The pump of FIG. 1 is illustrated in its operating condition wherein the fibers are rotated at a speed sufficient to axially elongate and extend from straight from hub 11 in a direction normal to the hub surface. The hub 11 includes a diamond or other hard material tipped needle bearing 17 which engages at opposite ends thereof with bearing holders 19. One such bearing holder is provided in the backwall 37 of a housing 21 of the illustrated pump, while the second bearing holder 19 is provided in a hub support 18 connected to housing 21. Bearing holders 19 only support the needle bearing 17 when the hub is at rest or at low rotation speeds. At other times the hub is magnetically suspended and the needle bearing 17 and bearing holders 19 are disengaged.

The hub further includes armatures 35 formed of samarium cobalt type magnets which cooperate with magnetic driving and suspension coils 25 and 27 respectively located in the backwall 37 and on the hub support 18. The driving and suspension coils operate in a conventional manner to both suspend and rotate the rotor 23 at a desired velocity. Since magnetic driving and suspension structures for rotating and suspension rotors are well known in the art, a detailed description thereof is deemed unnecessary. Representative magnetic rotor driving and suspension structures can be found in U.S. Pat. No. 3,066,849 to Beams and U.S. Pat. No. 4,043,614 to Lyman.

The backwall 37 includes a ceramic disc portion 29 located adjacent coil 25 which facilitates penetration of the rapidly time varying electro-magnetic fields from coil 25 to the hub 11 which occurs during suspension and rotation of rotor 23.

Figure 2:
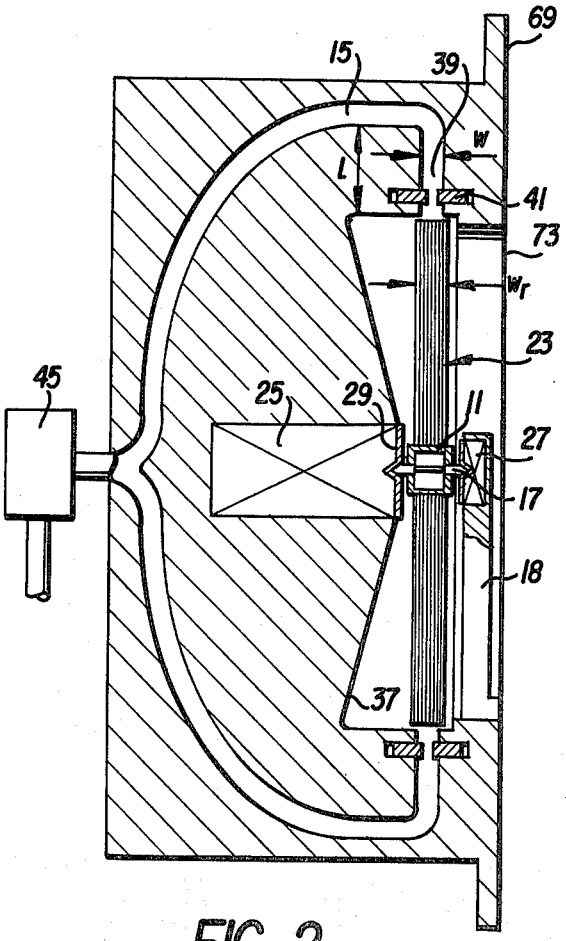
FIG. 2 illustrates a side sectional view of the pump of FIG. 1*a;*

The rotor is mounted within housing 21 which, for the pump illustrated in FIGS. 1*a* and 2, is formed as a stator structure 15 including an annular slot 39 which extends annularly around and spaced from rotor 23. Slot 39 is provided to receive molecules driven radially outwardly from the rotor 23 when struck by the rotating fibers 13. A molecular inlet 16 is provided to permit gas molecules to enter between the fibers 13 of the rotor where they are struck by the fibers. The inlet is illustrated as having a relatively short length. This is provided to facilitate passage of molecules into the rotor 23 as a longer inlet tends to cause more molecules to reflect back to a molecular source and away from the rotor.

Figure 1B:
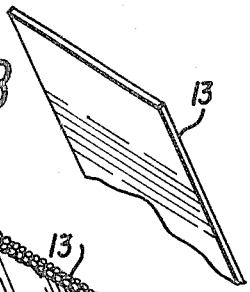
FIG. 1*b* illustrates one embodiment of the fibers which can be used in the pump of FIG. 1*a;*
Figure 1C:
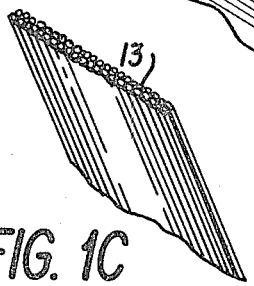
FIG. 1*c* illustrates a second embodiment of the fibers which can be used in the pump of FIG. 1*a;*

The fibers 13 can be constructed as ribbons, as illustrated in FIG. 1*b*, or as a plurality of individual round fibers. In the case of the latter, the fibers may be grouped to form a fiber array having an overall ribbon-like configuration, as illustrated in FIG. 1*c*. The fibers have a strength to density ratio sufficient to ensure their structural integrity at tip speeds which exceed the average thermal velocity of molecules struck thereby and may be formed of Kevlar (by Dupont), synthetic quartz, carbon, S-glass, steel or boron. The fibers are typically 12 microns thick, but this is merely exemplary.

The annular slot 39 provided in stator 15 is preferably formed as a continuous slot, but may be formed as a plurality of individual slots segmented by stator blades provided around the periphery of the rotor as indicated by the dotted lines in FIG. 1*a*. If individual slots are provided they have a radial length oriented tangentially to the tips of the fibers. The use of individual slots separated by stator blades provides an increased probability that a molecule entering a slot will not return to the rotor area, but with some sacrifice in pumping speed.

The pumping device further includes a front wall 73 which defines the opening of inlet 16 and a backwall 37. The backwall is provided with an angular shape relative to the radially extending fibers so as to direct molecules passing through the fiber array and striking the backwall towards the tips of the fibers where they may be suitably struck and directed toward slot 39. Although the inlet 16 is shown in a plane perpendicular to the hub axis, the inlet may reside in a plane at other angles to the hub axis.

The continuous slot 39, or plurality of slots, if provided, are fluid connected to an annular flow channel 15 which forms a removal path for molecules which are directed by the rotating fibers into the slot(s) 39. The annular flow channel 15 is connected to a viscous flow stage formed of a flow pump 45 which may be a conventional molecular backing pump or a high speed drag pump.

The slot or slots 39 provided radially of and annularly around the rotor 23 may have an opening adjuster 41 to permit dimensional adjustment of the flow path of molecules into slot 39.

The dimensions of slot 39 as well as the opening thereof can be suitably selected to achieve a predetermined probability that a molecule entering slot 39 will not return therefrom into the rotor area. The smaller the opening, the reduced probability of a gas molecule returning into the rotor area, but with this is a consequent reduction in pumping speed. The probability of a gas molecule entering slot 39 and returning to the rotor area is also affected by the length of the slot l and its width w, both illustrated in FIG. 2. The length l is greater than the width w and is preferably at least 10 times the width. With this ratio of length to width, 90 percent of the molecules entering slot 39 will not return to the rotor area. An overhanging portion 72 of front wall 73, formed by the radius of the rotor being greater than the radius of inlet 16, helps ensure that molecules entering the rotor area and struck by the fibers are not expelled back through the inlet 16 towards the molecule source. In addition, the width $w_r$ of the fiber array is greater than the width w of the associated slot 39 to further ensure that a molecule once captured in a slot is retained therein and does not enter back into the rotor area.

The pumping device illustrated in FIGS. 1*a* and 2 is relatively lightweight and requires relatively little energy for driving and suspending the rotor structure. Typically, the illustrated rotor would have a mass of 10 grams, a hub diameter of 1 cm, an overall diameter of 10 cm and require only 1 watt of driving energy, although these figures are merely exemplary. In addition, because of its light weight and reduced bulkiness, and further in view of the magnetic suspension of the rotor, the pumping device illustrated in FIGS. 1*a* and 2, although preferably mounted with the hub axis in parallel with the direction of gravity, can be mounted in any orientation desired thus providing a high degree of flexibility in use. To facilitate mounting, an attachment or mounting flange 69 is provided which can be used, for example, to attach the illustrated pump to a chamber to be evacuated.

Figure 3:
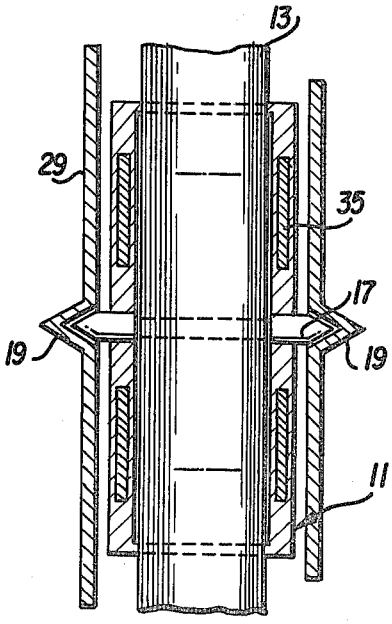
FIG. 3 illustrates a side sectional view of the hub structure of the pump illustrated in FIGS. 1*a* and 2.

The fibers may be mounted to the rotor by being attached solely to the outer periphery thereof, or, in the case of round fibers, by passing through the rotor and exiting from an opposite side. This latter technique is illustrated in FIGS. 3 and 4 where the fibers pass through the hub, bend around the needle bearing 17 and exit at an opposite side of the hub. Despite the bending of the fibers within the hub, they are made to exit the hub at an angle normal to its surface to ensure, during high speed rotation, minimum bending stress on the fibers.

An adhesive 47 is used to hold the fibers to the hub surface, whether the fibers end at the hub surface or project therethrough. The adhesive maintains the fibers normal to the hub surface.

To facilitate description of the pumping operation which occurs with the structures of FIGS. 1*a* and 2, reference will be made to FIG. 5. There a pair of fibers (either ribbons or a fiber array formed like a ribbon) are illustrated. When rotated to provide the fiber tips with a speed which exceeds the average speed of the molecules of a gas entering the rotor structure, the molecules striking the fibers exit therefrom with a speed corresponding to the rotor tip speed and with the molecular distribution 49 shown in FIG. 5. This distribution is proportional to the ratio of rotor tip velocity (V) to the average velocity of entering molecules (v), i.e., V/v. The higher the rotor tip velocity relative to the average velocity of entering molecules, the greater the peaking of the distribution. As illustrated, a high proportion of the particles struck by the fibers exit in a peaking direction towards the direction of rotor rotation and normal to the fiber sides at the time of collision. A lesser number of molecules exit from the fiber at other relatively narrow angles from the normal. As a consequence, a predominance of the particles struck by the fibers will have a directional component directed toward the continuous or segmented slots 39 annularly provided about the rotor. The directional component provided the molecules improves the efficiency of collection of the molecules by the stator slot(s) and removal thereof from the rotor area. The molecules struck by the rotor can achieve velocities greater than 7 times, and energies greater than 49 times, that achieved in presently known turbomolecular devices.

FIG. 5 also illustrates the relative spacing between the fibers 13 of rotor 23. The distance A between fibers at the rotor periphery is such that substantially 90 percent of the rotor periphery, as defined by the fiber ends, is left open with approximately 10 percent of this outer periphery being occupied by the fiber tip area. In subsequent embodiments, rotors having different packing density, that is, different amounts of open space at their outer peripheries will be described. In the FIGS. 1*a* and 2 embodiment, the rotor velocity (V), average molecular velocity (v), spacing between fibers at their tips (A) and axial extent width of the fiber array (t) are preferably related by the equation $$(V/v)=(A/t)$$

FIG. 5 also illustrates a circle at approximately half the radius of the fibers extending from hub 11. This area represents a portion of the fibers which may be stiffened relative to the end portions. Stiffening of the fibers, particularly relatively flexible fibers, ensures that the fibers, even at rest, will maintain a straight radial orientation normal to the hub over at least a portion of their length. This prevents tangling of the fibers when the rotor 23 is at rest, as only the end half of each of the fibers will be relatively flexible and loose. Stiffening may occur by suitably dimensioning the fibers themselves or by additional structures attached to and supporting the fibers.

In operation, gas molecules enter the rotor area through inlet 16 where they are struck by the rotor and acquire the rotor tip velocity and directional orientation illustrated in FIG. 5. A large proportion of the struck molecules are thus forced into slot 39 from which they are removed through annular flow channel 15 by flow pump 45. Any molecules which pass through the fibers of rotor 23 strike angled backwall 37 and are provided with a directional component towards the tips of the rotating fibers. The fibers attain tip speeds which exceed the average molecular velocity of the molecules in the entering free gas so that the molecular distribution 49 illustrated in FIG. 5 is obtained and maintained. The driving and suspension coils 25 and 27 both suspend and rotate the rotor 23 to obtain the tip speed noted. A typical pumping efficiency of greater than 40 percent can be obtained with the pump illustrated in FIGS. 1*a* and 2 with a maximum throughput of 1 liter-Torr/sec.

Another pump embodiment of the invention is shown in FIG. 6. In this embodiment, the fibers 13 of the rotor are arranged in three stages, 51,53 and 55, with the packing density of fibers in each stage remaining constant and the packing density of the fibers increasing from one stage to the next. In this embodiment, slots are not provided in the stator. Instead a sidewall 59 of housing 21 has a sloped surface 66 which directs molecules striking its surface back towards the rotor fibers 13 and from there into a molecular flow channel 15 which may be connected to a flow pump 45. The angle $\alpha$ of surface 66, taken from a plane perpendicular to the hub axis, is between 80 degrees and 45 degrees. The fibers of the three stages are cut to a tapered profile to maintain a predetermined gap 61 between the ends of the fibers and sloped surface 66. The first stage of fibers, that is the one closest to the inlet 16, has the lowest packing density and contains 90 percent open area at the fiber tips (the area A between fibers illustrated in FIG. 5). The next stage contains fibers packed more densely and has less than 5 percent open area at the fiber tips, while the final stage 3 is very closely packed to approximate a solid disc. If necessary, filler matrix material is provided in addition to the fibers or additional fibers can be glued to those attached to the hub to form a substantially solid disc surface.

In the embodiment of FIG. 6, the backwall is illustrated as a substantially flat surface, which may be stiffened to minimize deflection under vacuum loads. An angled backwall as shown in FIGS. 1*a* and 2 can also be provided. The suspension and driving structures of FIG. 6 are the same as those of FIGS. 1*a* and 2.

In operation, the rotor 23 of the FIG. 6 embodiment is rotated at a high speed which exceeds the average molecular velocity of the entering gas molecules. As a result, the fibers axially extend and straighten and molecules are struck by the rotor fibers and directed toward sidewall 59 with the molecular distribution illustrated in FIG. 5. The molecules, upon striking the sidewall 59, are directed back towards the fibers of the rotor with a directional component towards the flow channel 15 and continue to work back and forth between the fibers and sidewalls until they either pass through the fiber array into the molecular flow channel 15 or are forced upwardly over and around the third stage 55 of the fiber array, passing from there into molecular flow channel 15.

FIG. 7*a* illustrates another embodiment of a pump according to the invention which also relies on an increasing packing density along the axial extent of the rotor 23. In this instance, the packing density of the fibers continually increases from the molecular inlet 16 towards the molecular outlet 18 which is connected to flow pump 45 in the manner of the previous embodiments. The side wall 59 of the rotor housing in this embodiment contains a profile which facilitates interaction of the molecules with the sidewall and rotor to convey them toward the molecule outlet 18. The profile illustrated in FIG. 7*a* is a sawtooth shape having a wall component perpendicular to the axis of the hub and another wall component angled relative to the hub axis in a manner which causes a molecule striking the angled wall surface to be directed towards the outlet of the pump. The preferred angling $\theta$ of the angled wall component to the perpendicular wall component is 45 degrees, but it can be as large as 80 degrees.

Initially, molecules which strike the rotor 23 bounce between the angled wall components of sidewall 59 and fibers as they work their way through the rotor assembly and to the molecule outlet 18. When the molecules strike the rotor fibers, they receive a preferred momenta in a radially outward direction causing them to hit the contoured sidewall 59 and, more particularly, the angled wall component thereof, where they reflect in a preferred direction away from the molecular inlet 16 and towards the molecular outlet 18. The molecules have a reflection distribution which peaks about the normal to the angled wall component. As in the embodiment of FIG. 6, the fibers of the rotor 23 have a relatively open peripheral area, that is a small packing density, of substantially 90 percent open area at the tips of the fibers at the molecule inlet 16. The packing density continually increases from the molecule inlet 16 to the molecule outlet 18 where the fibers are packed closely together as to as form a substantially continuous fiber disc.

FIG. 7*b* illustrates an alternative to the sawtooth sidewall configuration of FIG. 7*a*. In FIG. 7*b*, a U-shape profile 67 provided in sidewall 59. The interaction of the molecules as they bounce between the fibers 23 of the rotor and the profile 67 of the sidewall conveys the molecules entering the rotor array towards the molecule outlet and away from the molecule inlet.

FIGS. 8*a* and 8*b* illustrate a molecular momentum transfer device using a fiber rotor for coating a substrate. FIG. 8*a* shows a front view without a front wall, while FIG. 8*b* ilustrates the front wall 73 in side view. Here the molecules entering housing 21 containing rotor 23 are struck by the rotating fibers leaving the fibers at a high velocity and striking a substantially continuous inner surface 46 provided circumferentially around the rotor 23. The inner surface is a substrate containing materials which may react with the molecules colliding therewith to form a coating or desired chemical reaction. In this structure, it is preferable to have a front wall 73 which substantially closes the large molecule inlet illustrated in the pumping device embodiments and which defines an aperture 75 located along the axis of the hub for the molecule entry. No molecule exit is required in this embodiment and the rotor area is surrounded by the housing 21, a backwall 37 and the front wall 73.

FIGS. 9*a*, 9*b* and 9*c* illustrate another molecular momentum transfer device using two fiber rotors constructed in accordance with the teachings of the invention. Each rotor contains the fiber array as illustrated in FIG. 1*a* or 2 or one of the arrays illustrated in FIGS. 6 or 7. In the FIG. 9*a* embodiment, a pair of rotors is provided respectively rotating clockwise and counter clockwise with the fiber array of the two rotors essentially located in a common plane. A molecule stream is directed from an aperture 75 between the rotating rotors with a directional component B perpendicular to the axes of the rotors and gas residing at the outer edge of the gas stream are separated or stripped off from the stream by the rotating rotors. This device may provide pumping of a particular gas or may be constructed as a gas separator for separating lower density gas molecules which tend toward the outer bounds of a gas mixture stream. The rotors illustrated in FIGS. 9*a* may be accompanied by stator structures such as illustrated in the prior embodiments of the invention, or may be used without a stator arrangment.

The arrangement illustrated in FIG. 9*b* is essentially the same as that of FIG. 9*a* with the two rotors axially aligned and the molecule beam having a directional component B perpendicular to the rotor axis.

FIG. 9*c* illustrates another arrangement similar to those of FIGS. 9*a* and 9*b* in which the axes of the two rotors are again in parallel, the fiber arrays are again in a common plane, but now the directional component B of the molecule stream is in parallel with the rotor axes. As in the FIG. 9*a* construction, the arrangements of FIGS. 9*b* and 9*c* may or may not have a stator arrangement as desired.

FIG. 10 illustrates another molecular momentum transfer device of the invention where a pair of fiber rotors 23 are provided and arranged such that molecules struck by the respective rotating fiber arrays are given a directional orientation towards one another such that an increased probability of collision occurs between molecules struck by respective arrays. A device having fiber rotors oriented in the manner of FIG. 10 could be used as a reaction device where reactions are caused by collision of high speed molecules exiting from the fiber arrays.

While several exemplary molecular momentum transfer device embodiments of the invention have been shown and described with particular reference to the unique fiber rotor construction of the invention, the above description is by no means limiting of the invention as many modifications can be made to the invention without departing from its spirit and scope.

Accordingly, the invention is not to be deemed as limited by the foregoing description, but as only by the claims appended hereto.

What is claimed:

1. A molecular vacuum pump for evacuating gaseous molecules from a chamber containing said molecules comprising:

a housing;

a first rotor mounted in said housing and including a first central hub and a plurality of fibers attached to and about the outer circumference of said hub, said fibers at the point of attachment to said hub being normal to said outer circumference and extending in a radial direction from an axis of said hub;

a molecule inlet provided in said housing and connecting with said chamber for establishing a path for molecules to flow from said chamber into said rotor;

means for rotating said rotor about its axis at a predetermined speed sufficient to axially extend and straighten said fibers and provide the ends of said fibers with a tip speed which equals or exceeds the average velocity of gaseous fluid molecules entering said rotor such that molecules struck by the sides of the ends of said fibers are propelled from a point radially outward of the hub where they are struck in a direction defined by a distribution function which peaks in a direction normal to the sides of said fibers and in the direction of fiber rotation;

an annular molecule exit path provided in said housing and surrounding said first rotor, said annular molecule exit comprising at least one exit slot spaced from the ends of the rotating fibers extending radially and annularly about the axis of said hub and receiving molecules struck by said rotor fibers;

a molecule discharge path connected to said annular molecule exit path; and means for magnetically suspending said rotor when said rotor is rotating at said predetermined speed.

2. An apparatus as in claim 1 further comprising a flow pump provided in said molecule discharge path.

3. An apparatus as in claim 1 wherein the diameter of said hub is substantially 1/10 the diameter of said rotor.

4. A molecular vacuum pump for evacuating gaseous molecules from a chamber containing said molecules comprising:

a housing;

a first rotor mounted in said housing and including a first central hub and a plurality of fibers attached to and about the outer circumference of said hub, said fibers at the point of attachment to said hub being normal to said outer circumference and extending in a radial direction from an axis of said hub;

a molecule inlet provided in said housing and connecting with said chamber for establishing a path for molecules to flow from said chamber into said rotor;

means for rotating said rotor about its axis at a predetermined speed sufficient to axially extend and straighten said fibers and provide the ends of said fibers with a tip speed which equals or exceeds the average velocity of gas fluid molecules entering said rotor such that molecules struck by the sides of the ends of said fibers are propelled from a point radially outward of the hub where they are struck in a direction defined by a distribution function which peaks in a direction normal to the sides of said fibers and in the direction of fiber rotation; and wherein said fibers are arranged on said hub so that the tips of said fibers, when rotating at said predetermined speed, define the circumferential periphery of said rotor of which said fibers occupy approximately 10 percent of the area thereof, the remaining area of the rotor periphery being open;

an annular molecular exit path provided in said housing and surrounding said first rotor, said annular molecule exit extending radially of said hub and receiving molecules struck by said rotor fibers;

a molecule discharge path connected to said annular molecule exit path; and means for magnetically suspending said rotor when said rotor is rotating at said predetermined speed.

5. An apparatus as in claim 1 wherein said fibers are constructed as a plurality of round fibers.

6. An apparatus as in claim 1 wherein said round fibers are grouped into a plurality of flat fiber bundles.

7. An apparatus as in claim 1 wherein said flat fiber bundles have a generally rectangular cross section and the greater dimension of said rectangular cross section extends in the direction of the axial extent of said hub.

8. An apparatus as in claim 1 wherein said annular molecule exit path comprises a plurality of slots provided annularly about said hub axis and each said slot has a length extending radially from said hub which is oriented tangential to the tips of said fibers when said fibers are rotating at said predetermined speed.

9. An apparatus as in claim 1 wherein each slot has a width extending in the same direction as the axis of said hub and the length of each said slot is larger than said width.

10. An apparatus as in claim 9 further comprising means for adjusting the opening dimension of each said slot.

11. An apparatus as in claim 9 wherein said length is at least 10 times said width.

12. An apparatus as in claim 1 wherein each said slot has a width extending in the same direction as the axis of said hub and the width of said fibers along the axial extent of said hub exceeds the width of each said slot.

13. An apparatus as in claim 1 wherein each said fiber passes through said hub on one side of the hub axis and exits from said hub on an opposite side of said hub axis such that a pair of fibers extending from said hub is formed of a single fiber strand.

14. An apparatus as in claim 1 wherein said hub includes a needle bearing extending along the axis of said hub and said apparatus further comprises means for engaging with said needle bearing to support said hub when at rest.

15. An apparatus as in claim 1 wherein said fibers are stiffened from a point where they engage with said hub to a point approximately halfway along their length.

16. An apparatus as in claim 1 wherein said molecule inlet provided in said housing is a circular opening centered about the axis of said hub, the radius of said rotor when rotating at said predetermined speed exceeding that of said inlet.

17. An apparatus as in claim 1 wherein said housing contains front and back walls, said front wall having said molecule inlet therein.

18. An apparatus as in claim 17 wherein said molecule inlet is centered along the axis of said hub.

19. An apparatus as in claim 1 wherein said fibers are formed of a material selected from the group consisting of: Kevlar, synthetic quartz, carbon, S-glass, and boron.

20. An apparatus as in claim 1 further comprising a backwall defined by said housing, said backwall being located on an opposite axial side of said rotor from said molecule inlet, said backwall having the shape of a conical sector concentric with said rotor, for causing molecules passing through said rotor and colliding therewith to be directed back toward the tips of the fibers of said rotor.

* * * * *